United States Patent [19]

Sejimo et al.

[11] Patent Number: 4,893,593

[45] Date of Patent: Jan. 16, 1990

[54] START-FUEL SUPPLY DEVICE IN INTERNAL COMBUSTION ENGINE FOR PORTABLE EQUIPMENT

[75] Inventors: Yoshimi Sejimo, Urayasu; Kohji Nagasaka, Kawasaki; Takeshi Kobayashi, Yokohama, all of Japan

[73] Assignee: Walbro Far East, Inc., Kawasaki, Japan

[21] Appl. No.: 273,891

[22] Filed: Nov. 21, 1988

[30] Foreign Application Priority Data

Jan. 18, 1988 [JP] Japan ..... 63-8187

[51] Int. Cl.[4] ..... F02M 1/08

[52] U.S. Cl. ..... 123/187.5 R; 123/179 G; 123/180 P; 261/DIG. 8

[58] Field of Search ..... 123/187.5 R, 180 E, 123/180 P, 179 A, 179 G; 261/DIG. 8

[56] References Cited

U.S. PATENT DOCUMENTS 3,371,658 3/1968 Turner ..... 123/187.5 R
4,373,479 2/1983 Billingsley et al. ..... 123/187.5 R
4,508,068 4/1985 Tuggle et al. ..... 123/187.5 R
4,676,204 6/1987 Inoguchi et al. ..... 123/180 P

FOREIGN PATENT DOCUMENTS 59-54758 3/1984 Japan ..... 123/187.5 R

*Primary Examiner*—Andrew M. Dolinar
*Attorney, Agent, or Firm*—Barnes, Kisselle, Raisch, Choate, Whittemore & Hulbert

[57] ABSTRACT

A start-fuel supply device in an internal combustion engine for a portable equipment comprising a start-fuel primer pump rotatively coupled to a starter motor of the engine, a fuel metering device for receiving a charge of fuel from a metering chamber of a carburetor during the reverse rotation of the start-fuel primer pump, and a fuel nozzle for injecting fuel from the fuel metering device to an air intake passage of the carburetor during the normal rotation of the fuel-start primer pump. A passage portion between the fuel metering device and the start-fuel primer pump is connected to a fuel reservoir through a by-pass passage provided with a check valve which allows a flow from the fuel metering device to the fuel reservoir.

3 Claims, 3 Drawing Sheets

START-FUEL SUPPLY DEVICE IN INTERNAL COMBUSTION ENGINE FOR PORTABLE EQUIPMENT

REFERENCE TO RELATED APPLICATIONS

Reference is made to the following filed U.S. applications which are assigned to an assignee common to the present application:

| | |
|---|---|
| Ser. No. 237,964 | Filed August 29, 1988 |
| Ser. No. 238,286 | Filed August 29, 1988 |
| Ser. No. 273,890 | Filed November 21, 1988 |

FIELD OF INVENTION

The present invention relates to a start-fuel supply device in internal combustion engines for portable equipment.

BACKGROUND OF THE INVENTION

Recently, it has become a practice to install a starter motor on the engine of reasonably light portable equipment such as a chain saw, a weed cutting machine and the like, to avoid the pull-start recoil starting operation commonly used. The internal combustion engine for a portable equipment for which a small high output is required is generally of a two-cycle type provided with a diaphragm type carburetor capable of coping with a variation in an attitude of a machine body, in which when the engine is started, a proper mixture can be supplied in accordance with the operating conditions and temperature conditions.

For example, Japanese Patent Application Laid-Open No. 35047/1987 discloses an arrangement wherein when the engine is started, a fuel is supplied by a manual primer pump from a fuel tank to a metering chamber of a carburetor and at the same time a fuel is also filled into an accumulator, and simultaneously with the recoil operation of the engine, the fuel in the accumulator is supplied by the operation of a button from a fuel nozzle to an air intake passage of the carburetor to produce a rich mixture necessary for the start.

In the case of the engine provided with a starter motor, such a manual operation is cumbersome, and if the motor is driven uselessly, a source battery becomes consumed.

In view of the foregoing, an object of the present invention is to provide a start-fuel supply in an internal combustion engine for a portable equipment in which a start-fuel pump is driven by a starter motor to inject a predetermined quantity of start-fuel to an air intake passage to thereby produce a rich mixture necessary for the starting of the engine.

BRIEF DESCRIPTION OF THE DRAWINGS

Drawings accompany the disclosure and the various views thereof may be briefly described as.

BRIEF DESCRIPTION OF THE INVENTION

Figure 1:
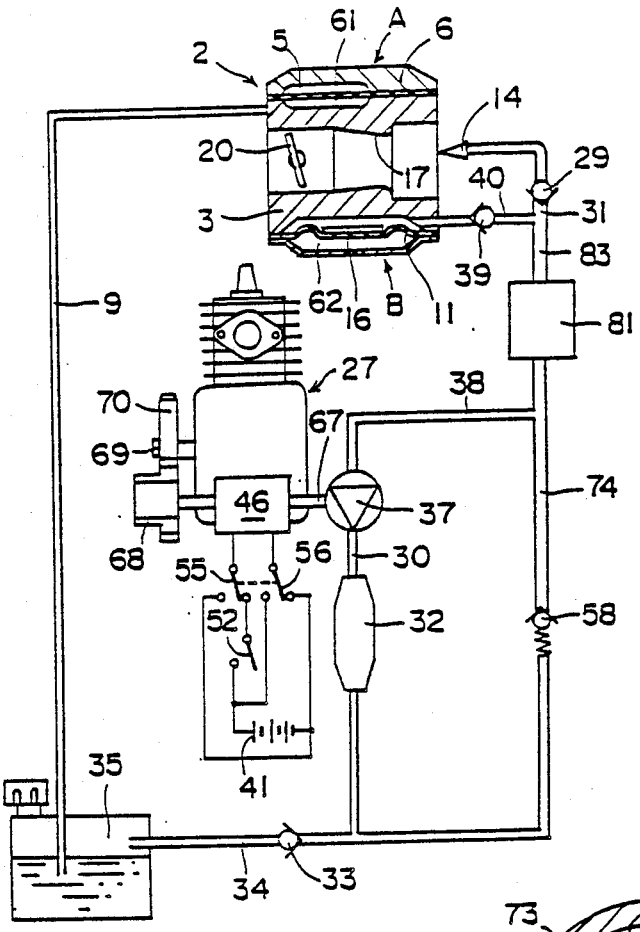
FIG. 1, a schematic view of a start-fuel supply device in an internal combustion engine for portable equipment.

For achieving the aforesaid object, the present invention provides a start-fuel pump rotatively coupled to a starter motor of the engine, a fuel metering device for reserving fuel from a metering chamber of a carburetor during the reverse rotation of the start-fuel pump, and a fuel nozzle for injecting a fuel in the fuel metering device to an air intake passage of the carburetor during the normal rotation of the fuel-start pump.

In the case where the engine is started, when a starter motor 46 is first operated in reverse, fuel in a fuel tank 35 is moved by a start-fuel pump 37 into a metering chamber 16 of a carburetor 2, and at the same time, a predetermined quantity of fuel is filled into a metering chamber **92*b* of a fuel metering device 81, extra fuel being returned to the fuel tank 35 via an escape valve or a check valve 33. Thereby, any lack of fuel resulting from a vaporization of fuel in the carburetor 2** is overcome and, at the same time, a quantity of start-fuel necessary for producing a rich mixture at the cold start is prepared.

When the starter motor 46 is then normally rotated, the engine is cranked, and the start-fuel in the metering chamber **92*b* of the fuel metering device 81 is injected from the fuel nozzle 14 to the air intake passage 17 of the carburetor 2** to produce a rich mixture necessary for the start so as to start the engine smoothly.

Detailed Description of the Invention and the Manner and Process of Using It FIG. 1 schematically shows a start-fuel supply device in an internal combustion engine according to the present invention. The start-fuel supply device comprises a volume type start-fuel pump 37 such as a gear pump, a vane pump or the like normally or reversely rotated by a reversible starter motor 46. A fuel reservoir 32 disposed between the start-fuel pump 37 and a fuel tank 35, a fuel metering device 81 disposed between the start-fuel pump 37 and a fuel nozzle 14, and the fuel nozzle 14 disposed at an air intake passage 17 of a carburetor 2.

The starter motor 46 causes a gear 68 coupled to a shaft 67 thereof to be disengageably meshed with a gear integral with a flywheel 70 coupled to a crank shaft 69 of the internal combustion engine 27. That is, only when the starter motor 46 is normally rotated, is the gear 68 meshed with the gear of the flywheel 70, and otherwise, such an engagement therebetween is released. A start-fuel pump 37 is rotatably coupled to the shaft 67 of the starter motor 46. The motor 46 is normally and reversely rotatably connected to a battery 41 via change-over switches 55 and 56 operatively connected therewith. However, a pump switch 52 is inserted and connected to a circuit for reversing the starter motor 46, and in the case where the start fuel need not be injected, the start-fuel pump 37 is not reversed.

The carburetor 2 is provided at the upper portion with a fuel pump A in which a pulsating pressure is introduced into a pulse chamber 5 above a pump chamber 61 defined by a diaphragm 6. At the lower portion of the carburetor 2 is a fuel supply mechanism B in which a metering chamber 16 and an atmospheric chamber 62 are defined by a diaphragm 11. In the normal operation of the engine, fuel in the fuel tank 35 is drawn into the fuel pump A via a pipe 9 and then sent to the metering chamber 16. Fuel in the metering chamber 16 is drawn into the air intake passage 17 via a fuel jet, not shown, by the intake negative pressure of the air intake passage 17.

When the primer pump 37 is normally rotated to supply fuel to the metering chamber 16, prior to starting the engine, the fuel in the metering chamber 16 is drawn into the start fuel pump 37 via a check valve 39, a passage 40, a passage 83, the fuel metering device 81 and a passage 38, and thence moved into the passage 30 and the fuel reservoir 32. Surplus fuel is returned to the fuel tank 35 via the check valve 33 and the pipe 34. As the metering chamber 16 assumes a negative pressure state, fuel in the fuel tank 35 passes through the pipe 9 and is supplied to the metering chamber 16 via the pump chamber 61 of the fuel pump A and a passage, not shown. At this time the crank shaft 69 is not rotated.

At the time of starting the engine, when the start fuel pump 37 is normally rotated by the starter motor 46, the fuel in the reservoir 32 is drawn into the start-fuel pump 37 via the passage 30, and thence fed to the fuel metering device 81 (FIG. 2) via the passage 38. The start-fuel in the metering chamber **92*b* (FIGS. 2, 4) of the fuel metering device 81 is injected into the air intake passage 17 from the fuel nozzle 14 via the passages 83, 31 and the check valve 29**.

To prevent an abnormal rise of discharge pressure of the start-fuel pump, a relief valve or a check valve 58 is provided in an outlet when the start-fuel pump 37 is normally rotated, that is, in a bypass passage 74 connecting between the side of the fuel metering device 81 and the fuel reservoir 32.

Figure 3:
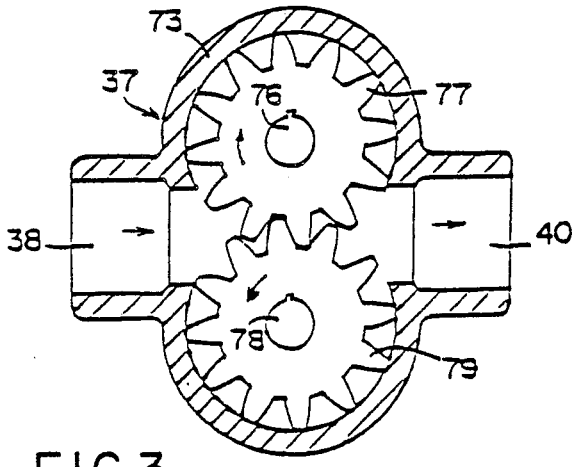
FIG. 3, a front sectional view showing an example of a gear pump as a start-fuel pump.

As shown in FIG. 3, a gear pump, for example, as the primer pump 37, has a casing 73 which accommodates therein gears 77 and 79 supported on shafts 76 and 78, respectively, in meshing engagement with each other, and if one of the shafts 76 and 78 is reversely rotated (in a direction indicated by arrow) by the starter cell motor 46, fuel is drawn through the passage 38 and discharged to the passage 40 after passing around the outside of the gears 77 and 79.

Figure 2:
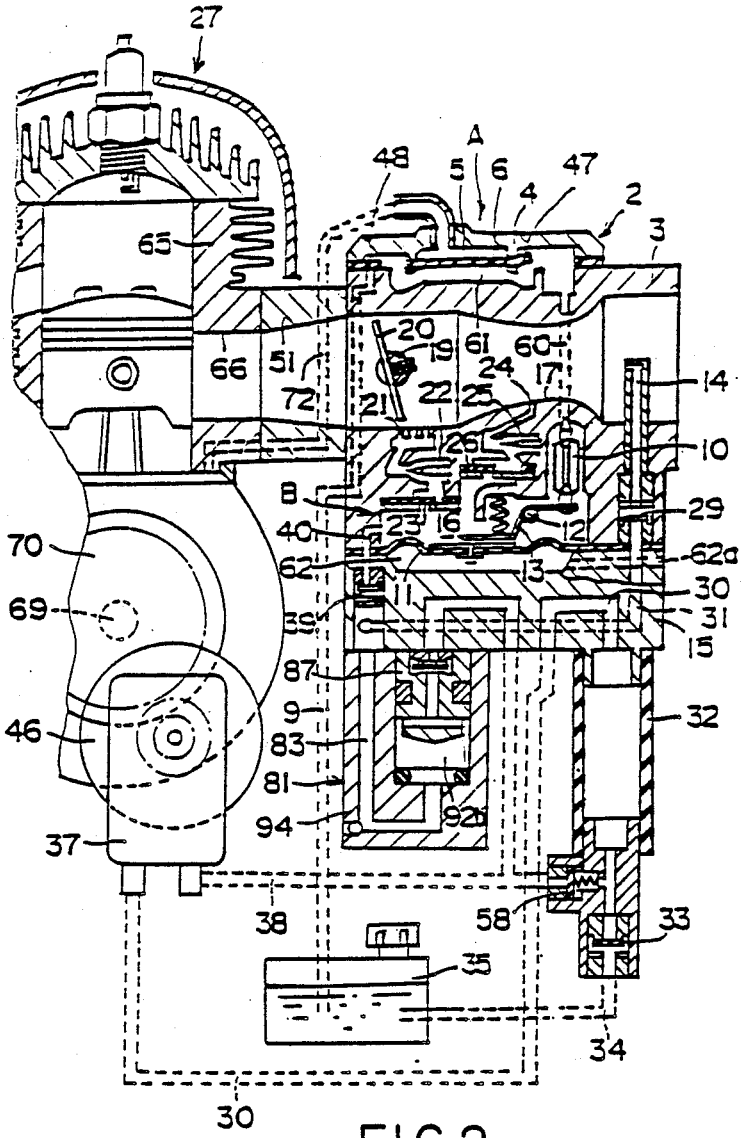
FIG. 2, a front sectional view showing the detailed structure of the start-fuel supply device.

FIG. 2 shows the mounting state of the carburetor 2 integrally provided with the fuel metering device 81, the start fuel pump 37, the fuel reservoir 32 and the fuel nozzle 14 to the internal combustion engine 27. On the side wall of the cylinder 65 of the internal combustion engine 27 are mounted the diaphragm type carburetor 2 and an air cleaner (not shown) through an intake pipe 51 formed from a heat insulating material in communication with an intake port 66.

In the carburetor 2, the air intake passage 17 including a venturi of the body 3 is communicated with an intake port 66 provided in a cylinder 65. Interiorly of the air intake passage 17 a well-known throttle valve 20 is rotatably supported by a valve shaft 19.

A cover 4 is coupled to the upper wall of the body 3 with a diaphragm 6 disposed therebetween, and a cover 15 is coupled to the lower wall with a diaphragm 11 disposed therebetween. The pulsating pressure introduced into chamber 5 is connected to a crank chamber of the engine 27 through a pipe 72. A pump chamber 61 is connected to a pipe 9 via check valve 48, whereas the pump chamber 61 is connected to the metering chamber 16 via a check valve 47, a passage 60 and an inlet valve 10.

An atmospheric chamber 62 between diaphragm 11 defining the metering chamber 16 and a cover 15 is open to the atmosphere by a passage **62*a*. The inlet valve 10 in the form of a needle valve is disposed on the end of the passage 60 and is opened and closed by a lever 13 supported on the wall of the metering chamber 16 by a shaft 12. Namely, one end of the lever 13 is biased into engagement with the end of the inlet valve 10 by means of the force of a spring. The other end of the lever 13 is formed in abutment with a projection coupled to an approximate center of the diaphragm 11. The metering chamber 16 is connected to a high-speed fuel jet 24 via a check valve 26 and high-speed fuel metering needle valve 25. The metering chamber 16 is connected to a low-speed fuel jet 21 via check valve 23 and a low-speed fuel metering needle valve 22**.

Figure 4:
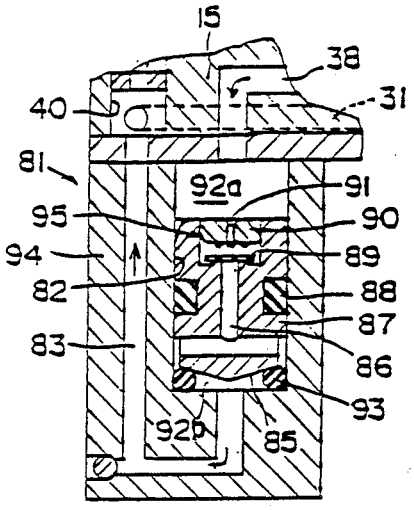
FIG. 4, a front sectional view of a fuel metering device for supplying a predetermined quantity of fuel from a fuel reservoir to a fuel nozzle.

The fuel metering device 81 ad the fuel reservoir 32 are coupled to the underside of a cover 15. As shown in FIG. 4, in the fuel metering device 81, a plunger 87 is fitted into a cylinder 82 of a body 94 thereof, and a chamber **92*a* is defined in the upper side thereof and a metering chamber 92*b* is defined in the lower side thereof. The chamber 92*a* is connected with the start-fuel pump 37 via the passage 38. The metering chamber 92*b* is connected to the metering chamber 16 via the passage 83, the check valve 39 (FIG. 2), and the passage 40, and connected with the fuel nozzle 14 via the passages 83, 31 and the check valve 29**.

A seal ring 88 to secure a liquid-tightness with the cylinder 82 is mounted on the plunger 87 with an ensmalled conical lower end 85 positioned to cooperate with a seal member 93 fitted into the cylinder 82. A check valve 95 is provided on the upper end of the plunger 87. An insert 90 has a jet bore 91 and is fitted into an open end of a cylindrical valve chamber. A movable valve body 89 in the form of a disk formed of rubber or the like is located within the valve chamber. The valve chamber containing the valve body 89 is connected with the metering chamber **92*b* via the axial passage 86, the diametrical passage in plunger 87 and a lower ensmalled diameter portion of the plunger 87. The valve body 89, when pressed down toward the valve seat on the upper end of the passage 86, cuts off communication between the chamber 92*a* and the metering chamber 92*b*, whereas the valve body 89, when forced upward, impinges upon a plurality of projections provided on the surface encircling the jet bore 91 of the seat plate 90 to connect the chamber 92*a* with the metering chamber 92*b***.

As shown in FIG. 2, the fuel reservoir 32 is preferably formed from a cylindrical element made of rubber or vinyl, to the lower end of which are coupled a check valve 58 and a check valve 33. The check valve 33 is opened, when the fuel reservoir 32 is filled with start-fuel, to return any extra fuel to the fuel tank 35 via the passage 34. The check valve 58 functions to allow a flow of fuel from the passage 38 to the fuel reservoir 32, thereby to release the discharge pressure of the start-fuel pump 37 after the start-fuel has been injected into the fuel nozzle 14.

The fuel nozzle 14 is disposed substantially in the center on the inlet side of the air intake passage 17, and a jet is directed downstream of the air intake passage 17.

OPERATION OF THE INVENTION

In the following, the operation of the start-fuel supply device in an internal combustion engine for portable equipment according to the reset invention will be described. Prior to starting of the internal combustion engine 27, when the change-over switches 55 and 56 are set by the key switch to the state as shown and the pump switch 52 is closed, the operation of the start-fuel pump 37 is reversed by the starter motor 46 which is also operating in reverse.

The fuel in the metering chamber 16 shown in FIG. 2 is drawn into the metering chamber 92*b* via the passage 40, the check valve 39 and the passage 83, and further drawn into the start-fuel pump 37 via the passage 86 of the plunger 87, the check valve 95, the jet bore 91, chamber 92*a* and the passage 38. The fuel is supplied by the start-fuel pump 37 to the fuel reservoir 32 via the passage 30. The extra fuel forces open the check valve 33 and is returned to the fuel tank 35 via the tube 34. At this time, the plunger 87 is raised by the fluid resistance of the jet bore 91 and the suction force of the start-fuel pump 37 to assume the state shown in FIG. 2.

When the change-over switches 55 and 56 shown in FIG. 1 are then switched, the start-fuel pump 37 along with the starter motor 46 are normally rotated, and the fuel in the fuel reservoir 32 shown in FIG. 2 is drawn into the start-fuel pump 37 via the passage 30. The fuel is fed from the start-fuel pump 37 of the chamber 92*a* shown in FIG. 4 via the passage 38. The check valve 95 is closed by the fuel pressure of the chamber 92*a* and the plunger 87 is forced down into abutment with the seal member 93. At that time, the fuel in the metering chamber 92*b* shown in FIG. 2 passes through the passages 83 and 31 to force open the check valve 29 and is injected from the fuel nozzle 14 into the air intake passage 17. At the same time, since the gears 68 and 69 are now engaged, the crankshaft of the internal combustion engine 27 is rotated by the starter motor 46, the rich mixture is drawn from the air intake passage 17 into the internal combustion engine 27, and the internal combustion engine 27 is started smoothly.

When the starter motor 46 is normally rotated even after the fuel in the metering chamber 92*b* has been injected out of the fuel nozzle 14, the fuel discharged from the start-fuel pump 37 forces open the check valve 58 and is returned to the fuel reservoir 32. That is, the fuel in the fuel reservoir functions, during the normal rotation of the start-fuel pump 37, to force down the plunger 87 of the fuel metering device 81 by the pressure of the discharged fuel.

When the start-fuel pump 37 is normally rotated, the fuel reservoir 32 is collapsed, but when the start-fuel pump 37 stops, the fuel reservoir 32 expands due to the resilient restoring force.

For example, in the starting conditions requiring no start-fuel such as is the case where the internal combustion engine 27 restarts immediately after the stoppage thereof, and the case where the ambient temperature is high, if the pump switch 52 remains opened, a supply of start-fuel to the fuel reservoir 32 caused by the reverse rotation of the start-fuel pump 37 is not affected, and, accordingly, even if the starter motor 46 is normally rotated, the start-fuel is not injected into the air intake passage 17.

The seal member 88 of the plunger 87 has the liquid tightness and adequate resiliency with respect to the cylinder 82 to prevent the plunger 87 from being naturally moved downward to insure the accurate fuel metering.

A quantity of start-fuel injected from the fuel nozzle 14 is determined according to the volume of the metering chamber 92*b* under the plunger 87. If the suction force is strong, the pressure in the metering chamber 16 abnormally lowers to sometimes generate a fuel vapor, and, therefore, the suction force of the plunger 87 is adjusted by the jet bore 91 provided in the plunger 87.

If the volume of the metering chamber 92*b* of the fuel metering device 81 is varied, an optimum amount of start-fuel can be supplied to adjust to engines having different displacement.

Actually, the fuel reservoir 32 need not be formed of a resilient material, and the check valve 33 need not be provided. However, when the fuel tank 35 assumes a positive pressure, a slight amount of fuel sometimes leaks from the shaft portion of the primer pump 37, and, therefore, the check valve 33 is preferably provided.

Review of the Operation

As described above, according to the present invention, a start-fuel pump is rotatively coupled to a starter motor of the engine. A fuel metering device for reserving fuel from a metering chamber of a carburetor during the reverse rotation of the start-fuel pump, and a fuel nozzle for injecting a fuel in the fuel metering device to an air intake passage of the carburetor during the normal rotation of the fuel-start pump are provided. Therefore, the start-fuel pump is driven by the starter motor which starts the engine, and a separate motor need not be provided. The construction is simple, and useful for small, lightweight devices.

When the start-fuel pump is reversed by the reverse rotation of the starter motor, a predetermined quantity of start-fuel is moved into the fuel metering device, and at the same time, fuel is moved into the metering chamber.

Therefore, the situation of a difficult start when the fuel in the metering chamber becomes vaporized under circumstances of non-use of the device for a long period of time, can be avoided. A predetermined quantity of start-fuel in the fuel metering device is directly injected from the fuel nozzle to the air intake passage of the carburetor during the normal rotation of the starter motor. Since the start-fuel pump is normally rotated by the starter motor having a high output, the start-fuel is injected at high pressure and quickly from the fuel nozzle to the air intake passage of the carburetor, and a rich mixture necessary for starting of the engine is rapidly supplied to the engine whereby the latter is started smoothly. Since the manual starting operation is not required as encountered in prior art, the operability is enhanced.

Since the check valve is provided in the by-pass passage, after the fuel in the metering chamber of the fuel metering device has been injected out of the fuel nozzle, the fuel discharged from the start-fuel pump circulates to the fuel reservoir via the check valve of the by-pass passage, and, therefore, an abnormal rise in the discharged pressure of the start-fuel pump is prevented.

What is claimed is:

1. A start-fuel supply device in an internal combustion engine for a portable equipment comprising a start-fuel primer pump rotatively coupled to a starter motor of the engine, a fuel metering device for receiving a charge of fuel from a metering chamber of a carburetor during the reverse rotation of the start-fuel primer pump, and a fuel nozzle for injecting fuel from the fuel metering device to an air intake passage of the carburetor during the normal rotation of the fuel-start primer pump.

2. The start-fuel supply device in an internal combustion engine for a portable equipment according to claim 1, wherein a passage portion between the fuel metering device and the start-fuel primer pump is connected to a fuel reservoir by a by-pass passage provided with a check valve which allows a flow from the fuel metering device to the full reservoir.

3. An apparatus for supplying start-fuel to an internal combustion engine for a portable type working machine in which a diaphragm carburetor has an air-fuel mixing passage with an air inlet, a metering chamber with conventional main and idle ports, a fuel supply tank, and a fuel pump to move fuel from said tank to said metering chamber, characterized in a supplemental fuel nozzle directed to said air inlet, a volume fuel reservoir in a conduit between said fuel nozzle and said fuel tank, a reversible power driven start-fuel primer pump associated with said conduit between said nozzle and said reservoir, a one-way connection between said metering chamber and said conduit, a fuel metering means associated with said conduit between said pump and said nozzle and between said metering chamber and said primer pump to direct fuel from said metering chamber to said reservoir during rotation of said primer pump in one direction while retaining a charge of start fuel, and moving said charge to said fuel nozzle upon reverse rotation of said primer pump, and a reversible starter motor for said engine operatively connected to said primer pump to engage an engine crankshaft operating in a first direction and to disengage said crankshaft while operating in a second direction, said primer pump operating also in one direction and the other dependent on the direction of movement of said starter motor.

* * * * *